US011353829B2

(12) United States Patent
Meyer et al.

(10) Patent No.: US 11,353,829 B2
(45) Date of Patent: Jun. 7, 2022

(54) WATCH CASE WITH A CONTROL THUMBWHEEL

(71) Applicant: ETA SA Manufacture Horlogere Suisse, Grenchen (CH)

(72) Inventors: Vincent Meyer, Biel/Bienne (CH); Raphael Balmer, Vicques (CH); Pascal Lagorgette, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 616 days.

(21) Appl. No.: 16/097,490

(22) PCT Filed: Nov. 22, 2017

(86) PCT No.: PCT/EP2017/080086
§ 371 (c)(1),
(2) Date: Oct. 29, 2018

(87) PCT Pub. No.: WO2018/108472
PCT Pub. Date: Jun. 21, 2018

(65) Prior Publication Data

US 2019/0146422 A1 May 16, 2019

(30) Foreign Application Priority Data

Dec. 16, 2016 (EP) ..... 16204651

(51) Int. Cl.
*G04G 21/00* (2010.01)
*G04G 17/02* (2006.01)

(52) U.S. Cl.
CPC ..... *G04G 21/00* (2013.01); *G04G 17/02* (2013.01)

(58) Field of Classification Search
CPC ..... G04G 21/00; G04G 17/02; G04G 21/08
See application file for complete search history.

(56) References Cited

U.S. PATENT DOCUMENTS 5,477,508 A * 12/1995 Will ..... G04G 21/00 368/189
6,134,189 A 10/2000 Carrard
(Continued)

FOREIGN PATENT DOCUMENTS

CH 514 877 7/1971
EP 0 974 879 B1 7/2007
(Continued)

OTHER PUBLICATIONS

Chinese Office Action dated Oct. 23, 2020 in Chinese Patent Application No. 201780036638.2, 3 pages.
(Continued)

*Primary Examiner* — Sean Kayes
(74) *Attorney, Agent, or Firm* — Oblon, McClelland, Maier & Neustadt, L.L.P.

(57) ABSTRACT

A watch case including a thumbwheel for controlling a watch function, configured to be manipulated by a user, movable inside a housing and configured to allow a limited translational motion of one portion of the thumbwheel in a radial direction of the case, against an elastic return configured to move the portion away from an interior of the case. The housing includes a control detector detecting presence of the portion close to the center of the case when pressure is applied by a user, and configured to activate or deactivate a sensor included in the case in proximity to the housing, configured, when a rotational movement is imparted to the thumbwheel by the user, to detect passage of a transmitter included in the thumbwheel.

16 Claims, 5 Drawing Sheets

(56) References Cited

U.S. PATENT DOCUMENTS

| | | | | |
|---|---|---|---|---|
| 6,278,661 | B1 * | 8/2001 | Higuchi | G04C 17/0066 368/28 |
| 6,385,136 | B2 * | 5/2002 | Higuchi | G04C 3/14 368/28 |
| 6,575,618 | B1 | 6/2003 | Inoue et al. | |
| 7,272,077 | B2 * | 9/2007 | Nobs | G04G 9/0076 368/187 |
| 7,506,269 | B2 | 3/2009 | Lang | |
| 2002/0101457 | A1 | 8/2002 | Lang | |
| 2003/0099165 | A1 * | 5/2003 | Terasawa | G04B 19/286 368/294 |
| 2006/0139320 | A1 | 6/2006 | Lang | |
| 2007/0189127 | A1 * | 8/2007 | Pollak | G04B 37/1486 368/294 |
| 2008/0117723 | A1 * | 5/2008 | Hiranuma | G04B 19/283 368/294 |

FOREIGN PATENT DOCUMENTS

| | | | |
|---|---|---|---|
| EP | 3 032 360 | A1 | 6/2016 |
| FR | 2 763 710 | B1 | 11/1998 |

OTHER PUBLICATIONS

International Search Report dated Apr. 4, 2018 in PCT/EP2017/080086 filed Nov. 22, 2017.

* cited by examiner

WATCH CASE WITH A CONTROL THUMBWHEEL

FIELD OF THE INVENTION

The invention concerns a watch case comprising a housing inside which is at least rotationally movable at least one thumbwheel for controlling a display or a function of the watch, said thumbwheel being arranged to be manipulated directly by the watch user via a peripheral contact surface, said housing being arranged to allow a limited translational motion, between an internal end position and an external end position, of at least one portion of said thumbwheel in a radial direction of said case, against elastic return means which are arranged to move said portion away from the interior of said case, and said case including at least a first control detection means arranged to detect the presence of said thumbwheel portion close to the centre of said case when pressure is applied by a user, or in the internal end position, said first detection means being arranged to activate or deactivate sensor means comprised in said case in proximity to said housing, which sensor means are arranged to detect, when a rotational movement is imparted by the user to said thumbwheel, the passage of transmitting means comprised in said thumbwheel.

The invention also concerns a watch including a case of this type.

The invention concerns the field of mechanisms for controlling watch functions for watches.

BACKGROUND OF THE INVENTION

For using the many functions of current watches, there are limited user interfaces. The best known are the crown, push-buttons and pull-out pieces. There are also touch screens, having zones for the selection of certain functions, or rotating bezels.

Many control means are fragile, or unsuitable for use in all conditions.

US Patent Application No 2002/101457A1 in the name of MICROSOFT discloses a user interface for small computing devices. The user interface includes a display screen and a bezel surrounding the display screen. The bezel is devised to move relative to the display screen on one or more axes. The bezel can pivot about the display screen, pivot about a pivot point or be moved in a planar direction. A cursor displayed in the display screen reacts to the movement of the bezel.

European Patent Application No EP3032360A1 in the name of The Swatch Group Research & Development Ltd discloses a timepiece including a case middle closed by a back cover and a crystal in which an electronic system is arranged, the case middle including a peripheral shoulder including a base and a side wall parallel to the central axis of the case middle, the timepiece including a bezel locked in rotation about the central axis on the peripheral shoulder, said ring has at least one degree of freedom allowing the electronic system to control the timepiece.

European Patent Application No EP0974879A1 in the name of SEIKO discloses an information processing device in which data can be entered by using a rotating bezel. A pulse-number detection unit and a rotational direction detection unit read an optical pattern which is formed by the rotating bezel to generate a series of pulse signals. The pulse-number detection unit and the rotational direction detection unit are arranged such that a phase difference is produced between their signals, so that it is possible to determine the direction of rotation of the rotating bezel. A data signal generating element generates a data signal on the basis of the detected rotational angle and number of pulses generated by the pulse-number detection unit.

French Patent Application No FR2763710A1 in the name of JDC Electronic discloses a device mounted in a timepiece and comprising means generating a variable inductive magnetic current formed of a movable member having one part made of material that conducts the inductive magnetic current and one non-conductive part. The device includes means for detecting the variable inductive magnetic current, means for processing signals from said detection means and means for controlling the watch functions. This device makes it possible to control a timepiece without requiring an element that passes through the case, so that the timepiece can be sealed.

Swiss Patent Application No. CH514877A in the name of SPILLMANN discloses a water-resistant watch with a rotating bezel, in which the crystal and the rotating bezel are secured by the single same annular component, which forms a bezel and has a cylindrical cover snap fitted into a groove in the case middle, and an internal shoulder of said component retains the crystal with its heel and an external shoulder retains the rotating bezel.

SUMMARY OF THE INVENTION

The invention intends to provide a novel user interface which is more suited to a watch, especially to a smart watch having electronic and/or communication functions, than these conventional solutions, which can also function in a damp environment, or even in water, or with wet hands, while providing good shock protection.

To this end, the invention concerns a watch case according to claim 1.

The invention also concerns a watch comprising such a case, arranged to contain a timepiece movement, wherein the display or watch functions are arranged to be controlled by sensor means comprised in said case.

BRIEF DESCRIPTION OF THE DRAWINGS

Other features and advantages of the invention will appear upon reading the following detailed description, with reference to the annexed drawings, in which:

FIG. 15—a case having openings for the thumbwheel at 3 o'clock, 6 o'clock, 9 o'clock, 12 o'clock.

FIG. 16—a cross-section of the detail of the openings on the 3 o'clock-9 o'clock axis and on the 6 o'clock-12 o'clock axis;

FIG. 17—a case with two openings at 3 o'clock and at 9 o'clock, with a pusher opposite each of said openings.

FIG. 17—a cross-section of a case with two superposed thumbwheels according to the invention, each cooperating with its own opening.

FIG. 19—a case including sensor means housed inside a horn, cooperating with the peripheral surface of the thumbwheel.

FIG. 20—a pusher combined with sensor means including a pinion cooperating with a toothing comprised in the thumbwheel.

DETAILED DESCRIPTION OF PREFERRED EMBODIMENTS

The invention concerns a watch case 1 comprising a housing 2 inside which is at least rotationally movable at least one thumbwheel 3 for controlling a display or a function of the watch. This thumbwheel 3 is arranged to be manipulated directly by the watch user via a peripheral contact surface 4. The term 'case' is to be interpreted in the broad sense: this case 1 can naturally be a case middle or suchlike.

Figure 1:
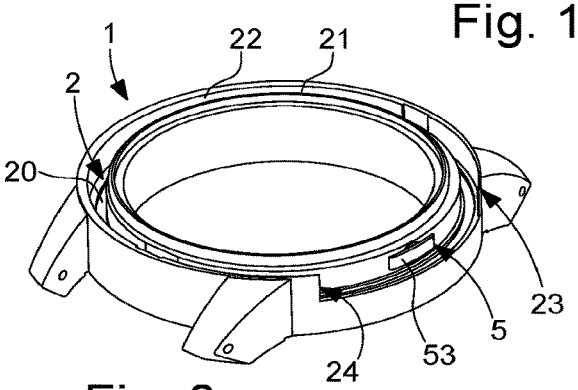
FIG. 1 represents a schematic, perspective view of a watch case according to the invention, comprising a housing for receiving a thumbwheel, interrupted by an opening inside which a pusher is movable.
Figure 2:
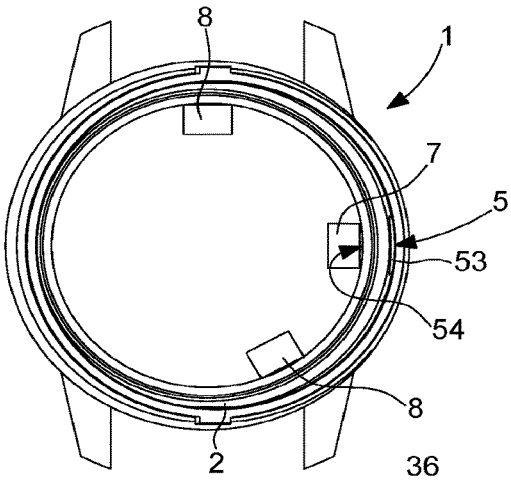
FIG. 2 represents a schematic, plan view of the case of FIG. 1, provided with sensor means in proximity to the pusher, and sensor means in proximity to the housing.
Figure 5:
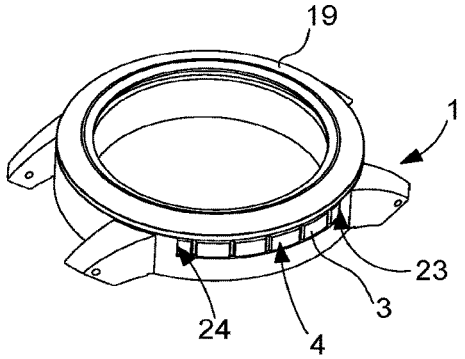
FIG. 5 shows a schematic, perspective view of the case of FIG. 3, in a variant wherein a circular cover encloses the thumbwheel.
Figure 6:
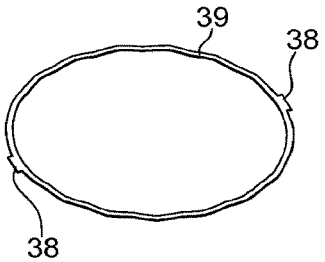
FIG. 6 represents a schematic, perspective view of a notched ring intended to be inserted into the housing of the case beneath the thumbwheel, for a notching effect.
Figure 7:
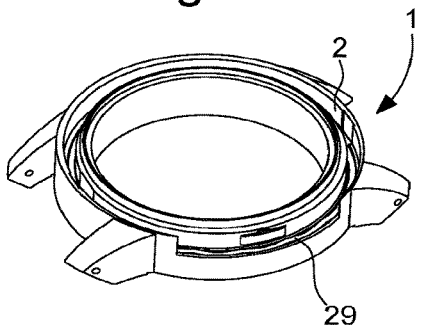
FIG. 7 shows a schematic, perspective view of the case of FIG. 1, in which the notched ring of FIG. 6 is inserted.
Figure 8:
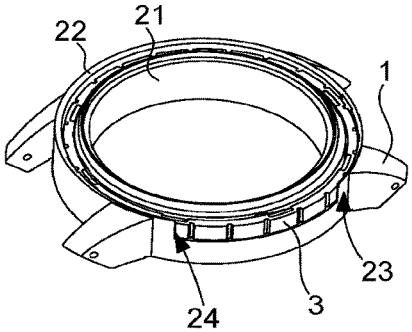
FIG. 8 represents a schematic, perspective view of the case of FIG. 7, in which the thumbwheel is inserted above the notched ring of FIG. 6.
Figure 9:
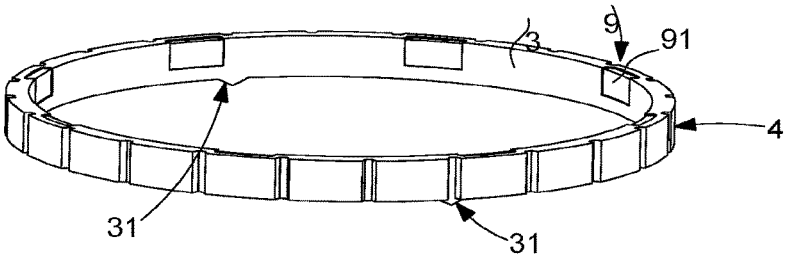
FIG. 9 represents a schematic, perspective view of a thumbwheel including transmitting means formed by magnets, and including, in a lower portion, relief portions formed by V-shaped lugs arranged to cooperate with the broken line profile of the notched ring of FIG. 6.
Figure 10:
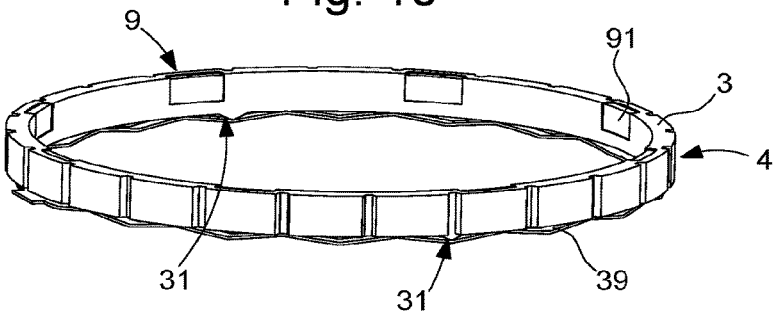
FIG. 10 represents a schematic, perspective view of the cooperation between the thumbwheel of FIG. 9 and the notched ring of FIG. 6.

FIGS. 1 and 2 show one such case 1, inside which housing 2 is a slotted groove, with, on either side of a bottom 20, an internal wall 21 and an external wall 22. This external wall 22 is interrupted between two edges 23 and 24, arranged to define an opening through which a user can operate a thumbwheel 3 inserted inside housing 2, as seen in FIG. 5.

The geometry of housing 2 allows the insertion, with play, of such a thumbwheel 3, and in particular makes it possible for thumbwheel 3 to turn and move in translation over a short distance, for example but not limited to the 3 o'clock-9 o'clock direction on case 1 illustrated by the Figures, and with an opening so that the watch user can make two movements: radially pushing and rotating thumbwheel 3.

According to the invention, this housing 2 is arranged to allow a limited translational motion, between an internal end position and an external end position, of at least one portion 30 of thumbwheel 3 in a radial direction of case 1, against elastic return means 5, which are arranged to move portion 30 away from the interior of case 1. It is understood that portion 30 is not always the same: it is simply the portion of thumbwheel 3 which, at a given instant, faces the opening, defined in the Figures by the two edges 23 and 24.

The Figures illustrate a particular variant wherein housing 2 of thumbwheel 3 is in immediate proximity to the periphery of case 1. Thus, thumbwheel 3 surrounds a movement 100, with no direct contact therewith.

Other variants can be realized, in particular with a small thumbwheel, which does not go all the way around the watch, but which is substantially internally tangent to its periphery, with only one portion 30 of thumbwheel 3 being, as previously, accessible to the user. Housing 2 of this small thumbwheel is also separated, in a sealed manner, from the inner compartment of case 1 which contains movement 100.

Elastic return means 5 perform the function of pushing thumbwheel 3 back towards the exterior of case 1 at rest, at the opening.

To perform the pressure detection function when thumbwheel 3 is depressed, in proximity to housing 2, case 1 also includes at least a first control detection means 7, which is arranged to detect the presence of portion 30 of thumbwheel 3 close to the centre of case 1 when a user applies pressure, and particularly in the internal end position.

In particular but not exclusively, and as seen in FIGS. 1 to 4, case 1 can be provided with a pusher 54 forming said elastic return means 5, which biases thumbwheel 3 into an end position in the direction in which it can move in translation, in the 3 o'clock position in the particular case of the Figures. More particularly, this pusher 54 includes a pad-like head 53 to facilitate the rotation of thumbwheel 3. On the inner side of case 1, this pusher 54, which passes through internal wall 21 here, has a tail arranged to cooperate with a first control detection means 7. Because of its small dimensions, this pusher 54 does not cause any sealing problems. For a more demanding environment, such as in a diving watch or similar, it may be advantageous to separate the function of pushing thumbwheel 3 towards the exterior of watch 1 at rest, at the opening, for example via a strip spring or similar, from the pressure detection function when thumbwheel 3 is depressed, by means of a stress gauge in internal wall 21, an inductive sensor, using a deformable wall, or otherwise.

Figure 3:
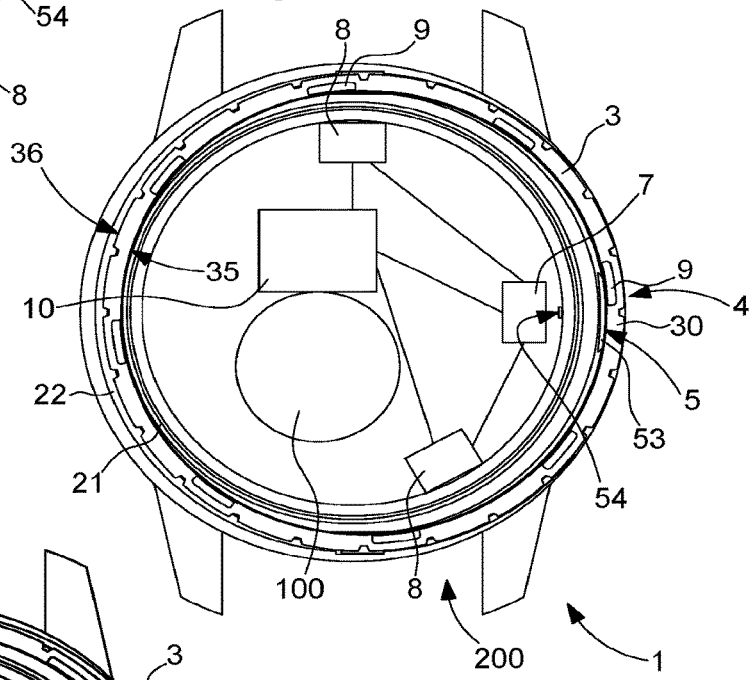
FIG. 3 represents a schematic, plan view of the case of FIG. 2, provided with the thumbwheel inside its housing, of a timepiece movement, and control means connected to the detection means and to the sensor means, in a rest position of the thumbwheel.

FIG. 3 shows the system at rest, pusher 54 holds thumbwheel 3 to the 3 o'clock position.

Figure 4:
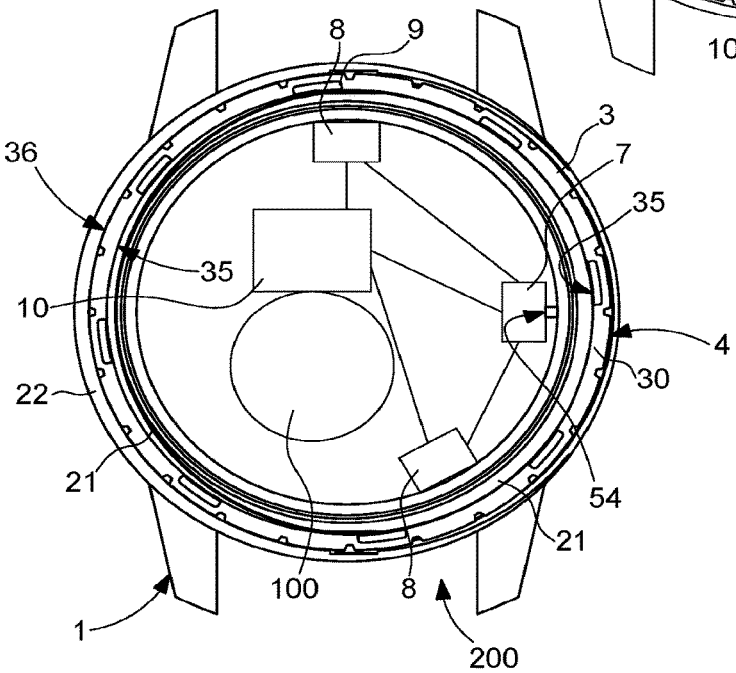
FIG. 4 represents a schematic, plan view of the case of FIG. 3 in an activated position of the thumbwheel by pressure applied by a user.

FIG. 4 shows the system when thumbwheel 3 is pressed by a user: its local area 30 then moves in translation from a 3 o'clock position to the 9 o'clock position, and pusher 54 is pushed towards the interior of case 1. For example, this pressure is detected by an electronic module in movement 100 of watch 200.

This first detection means 7 is arranged to activate or deactivate sensor means 8 comprised in case 1 in proximity to housing 2, which sensor means 8 are arranged to detect, when a rotational movement is imparted to thumbwheel 3 by the user, the passage of transmitting means 9 comprised in thumbwheel 3.

More particularly, transmitting means 9 are discontinuous, and arranged at different angular intervals around thumbwheel 3.

More particularly, sensor means 8 are kept apart from transmitting means 9; this is therefore a contactless interaction.

In a particular variant, at least one of sensor means 8 is arranged to detect the direction of travel and/or reversal in the direction of travel of a transmitting means 9.

In a particular variant, at least one of sensor means 8 is arranged to detect the angular separation between two successive transmitting means 9.

In a particular variant, at least two of sensor means 8 are arranged to detect the passage of the same transmitting means 9.

In a particular variant, at least one sensor means 8 is arranged to measure the angle of rotation of thumbwheel 3 traveled after control detection has been effected by first detection means 7.

In a particular variant, at least one of sensor means 8 is arranged to change position when a transmitting means 9 passes in proximity thereto. More particularly, such a sensor means 8 forms a mechanical switch, arranged to control a mechanical or electronic function of a timepiece movement 100 contained in case 1. The mechanism according to the invention can therefore, in a particular variant, be entirely mechanical. The combination of movable components for starting and stopping a function may also be sequential. For example, any rotational movement of the thumbwheel may successively activate, in a chronograph mechanism, the start, stop and reset functions.

In an advantageous variant, case 1 includes control means 10, which are arranged to control signals transmitted and received in first detection means 7 and sensor means 8, to activate or deactivate said sensor means 8, and, when sensor means 8 are activated, to analyse the number of transmitting means 9 identified by sensor means 8 and/or the angular distance between pairs of transmitting means 9, and/or the directions of travel of transmitting means 9, to transform the result of analysis into an order for the display or activation of a watch function, addressed to a timepiece movement 100 contained in case 1. More particularly, detection means 7 and/or sensor means 8 and/or control means 10 are of an electronic type.

In a particular variant, thumbwheel 3 is flexible and actually forms elastic return means 5. In this variant, housing 2 may consist of a circular slot, which is perfectly annular, and pusher 54, arranged for detecting the application of pressure, advantageously performs the additional function of tensioning flexible thumbwheel 3, and thus locally gives said flexible thumbwheel 3 a circular shape.

In another particular variant, illustrated by the Figures, thumbwheel 3 is rigid, and elastic return means 5 include a pusher 54, which is arranged to rest on thumbwheel 3 via its head 53.

Figure 11:
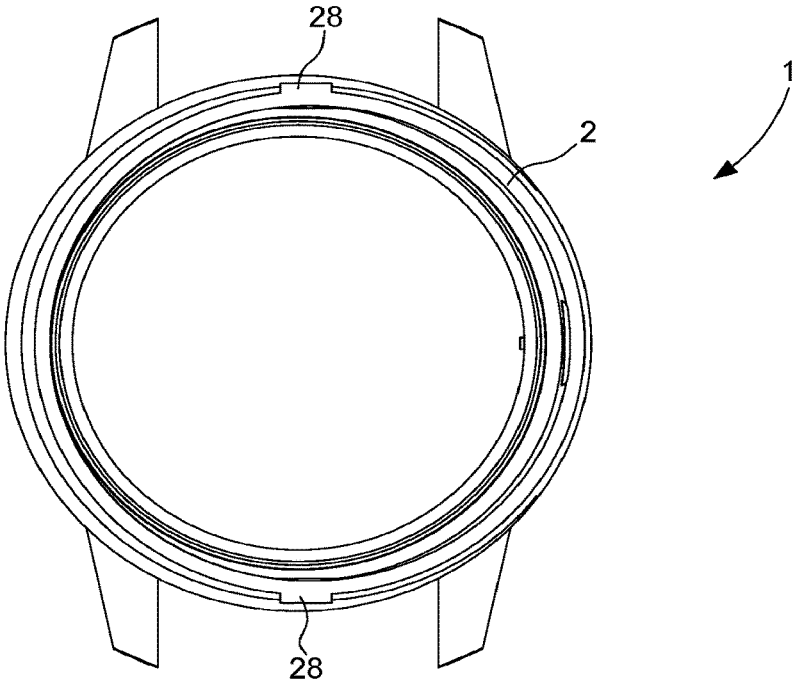
FIG. 11 shows a schematic plan view of the detail of the housing of the case of FIG. 1.
Figure 14:
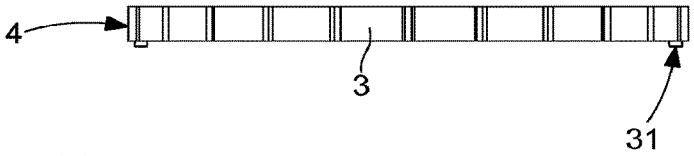
FIGS. 12, 13, 14 represent three schematic plan views of the notched ring of FIG. 6.
Figure 12:
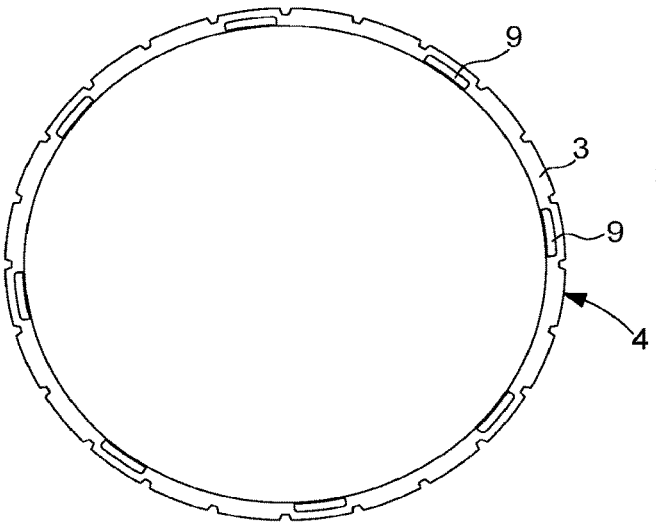
Figure 13:
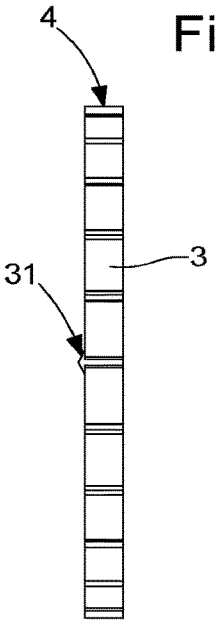
Figure 15:
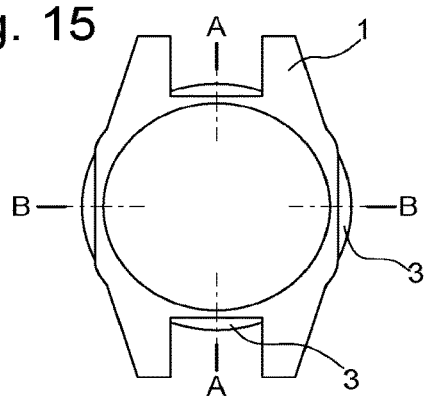
FIGS. 15 to 20 represent schematic views of the principles of a few variants of the invention.

In a particular variant illustrated by the Figures, thumbwheel 3 is annular, and housing 2 is an oval including two half-rings connected by two straight sections, as seen in FIG. 11. In a variant, each half-ring is not strictly circular, but the outermost circle, leading to the opening, has an eccentricity, slightly greater than the value of the difference between the two inner circles, so that thumbwheel 3 projects from one side of the case middle but not from the other.

Other housing shapes can be envisaged, for example substantially elliptical, or substantially annular, of variable width, and whose projection onto any line parallel to the radial direction of case 1 is at least equal to the distance between the internal end position and the external end position. Preferably, housing 2 is shaped such that the play between thumbwheel 3 and internal and external walls 21 and 22 is as small as possible, but without producing excessive friction.

In a particular variant, first detection means 7 is a switch activated by elastic return means 5 or by a pusher 54 comprised in elastic return means 5.

In the variant illustrated by the Figures, thumbwheel 3 is provided with magnets which form transmitting means 9, especially but not exclusively, arranged regularly over its entire periphery, which makes it possible to detect the rotation of thumbwheel 3, via one or more sensors inside the case middle which constitute sensor means 8.

Thus, in a particular variant, sensor means 8 are magnetic sensors, which, once activated, are arranged to detect the passage of magnets 91 comprised in transmitting means 9. More particularly, these magnets 91 are arranged at a constant angular interval around thumbwheel 3. In another variant, these magnets 91 are arranged at different angular intervals around thumbwheel 3.

In a particular variant, thumbwheel 3 includes, on a face arranged to cooperate with bottom 20 of housing 2, a relief portion 31 which is arranged to cooperate with a complementary relief portion 21 comprised in bottom 20, for braking by means of notches during rotation of thumbwheel 3.

In a particular variant, thumbwheel 3 includes, on a face arranged to cooperate with bottom 20 of housing 2, a relief portion 31 which is arranged to cooperate with a notched ring 39 inserted between thumbwheel 3 and bottom 20, for braking by means of notches during rotation of thumbwheel 3. More particularly, this notched ring 39 is an elastic ring. More particularly, this notched ring 39 includes at least one radial stop lug 38, arranged to cooperate in a complementary manner with a recess 28 of housing 2.

Thus, a notching system is achieved in a simple manner for the thumbwheel, which is more pleasant for the user than mere friction. This ring 39 with a series of bumps and hollows is inserted into housing 2 with thumbwheel 3, which is provided on its lower face with at least one relief portion 31. FIGS. 9, 10, 13, 14 show two such relief portions 31 formed by V-shaped lugs. Thus, when thumbwheel 3 turns, each V-shaped lug jumps from one hollow in the ring to the next.

In a variant, case 1 includes a cover 19 or a bezel or a bottom, or an additional spacer, this component being arranged to enclose thumbwheel 3 inside case 1, as seen in FIG. 5.

The principle of the invention is applicable to many variants, depending on the space available inside the watch case, the thickness of said case and the number of functions to be controlled.

Figure 17:
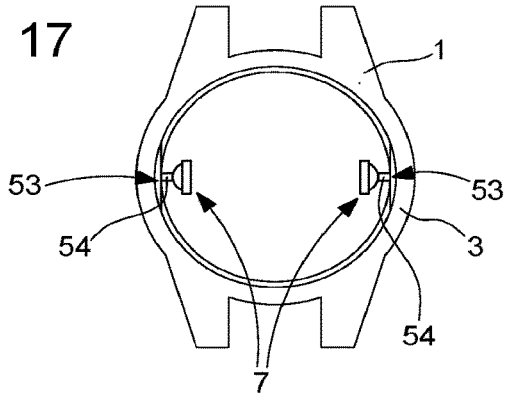

Thus, FIG. 17 illustrates a case 1 with two openings at 3 o'clock and at 9 o'clock, with a pusher 54 facing each of these openings. Thumbwheel 3 is accessible at 3 o'clock and 9 o'clock, and the presence of a pusher 54 on each side allows navigation of menus: activation of rotation detection at 3 o'clock and 9 o'clock, then 'validation ok' at 3 o'clock and 'return' at 9 o'clock (or the reverse).

Figure 16:
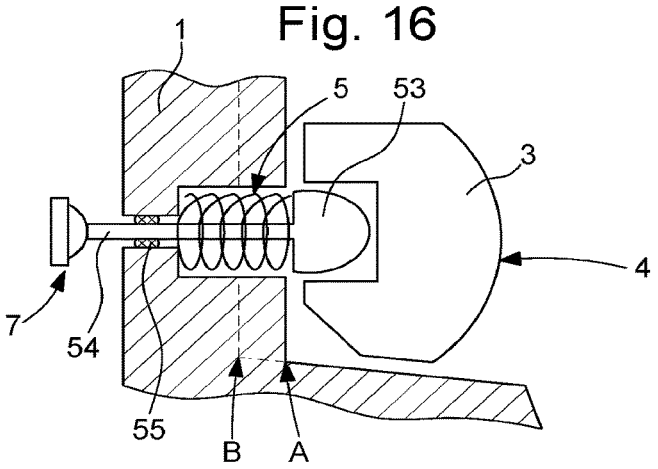

Another variant of the case, illustrated in FIGS. 5 and 16, includes four pushers which are not shown in detail (some of which may not have rotation detection) and a thumbwheel geometry suitable for dispensing with a vertical locking component (no bezel or bottom ring).

Figure 18:
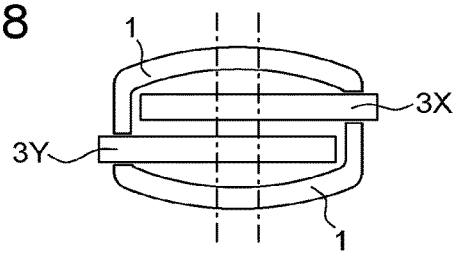

Yet another variant concerns a case with several superposed thumbwheels according to the invention, each cooperating with its own opening. FIG. 18 illustrates an example with two thumbwheels 3X and 3Y, wherein case 1 has, for example, but not exclusively two diametrically opposite openings, one for each thumbwheel. The same housing 2 can enclose several thumbwheels 3, or each thumbwheel 3 can have a separate housing 2.

Figure 19:
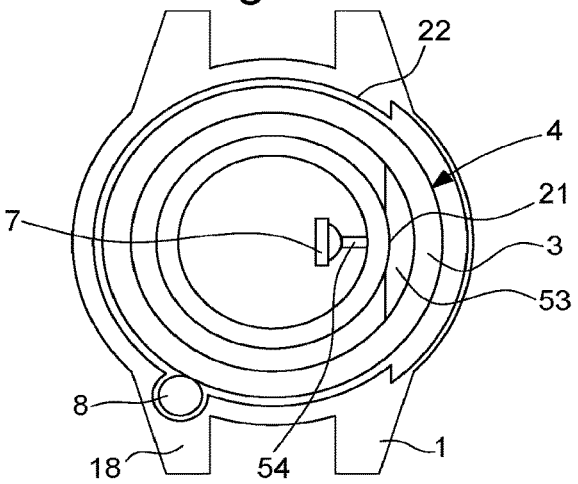

FIG. 19 illustrates a case variant including sensor means 8 housed inside a horn 18, cooperating with peripheral surface 4 of thumbwheel 3, either by mechanical frictional or direct driving contact if, for example, peripheral surface 4 is fluted or similar, or by magnetic interaction, or otherwise.

Figure 20:
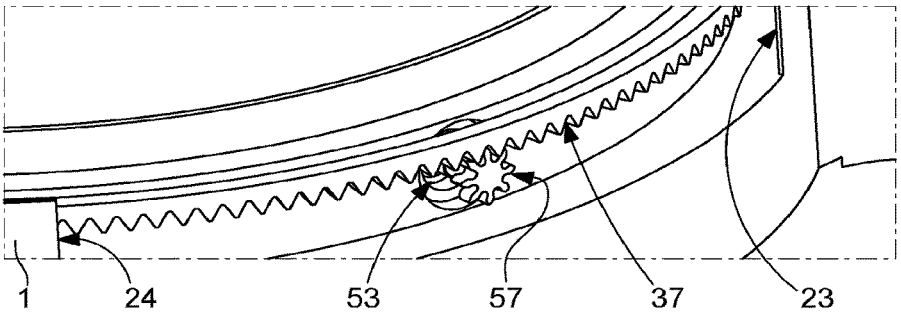
Figure 21:
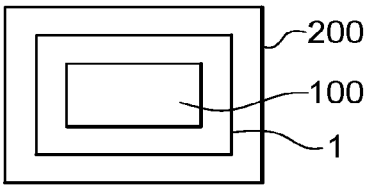
FIG. 21 is a block diagram representing a watch including a movement and a case according to the invention.
Figure 22:
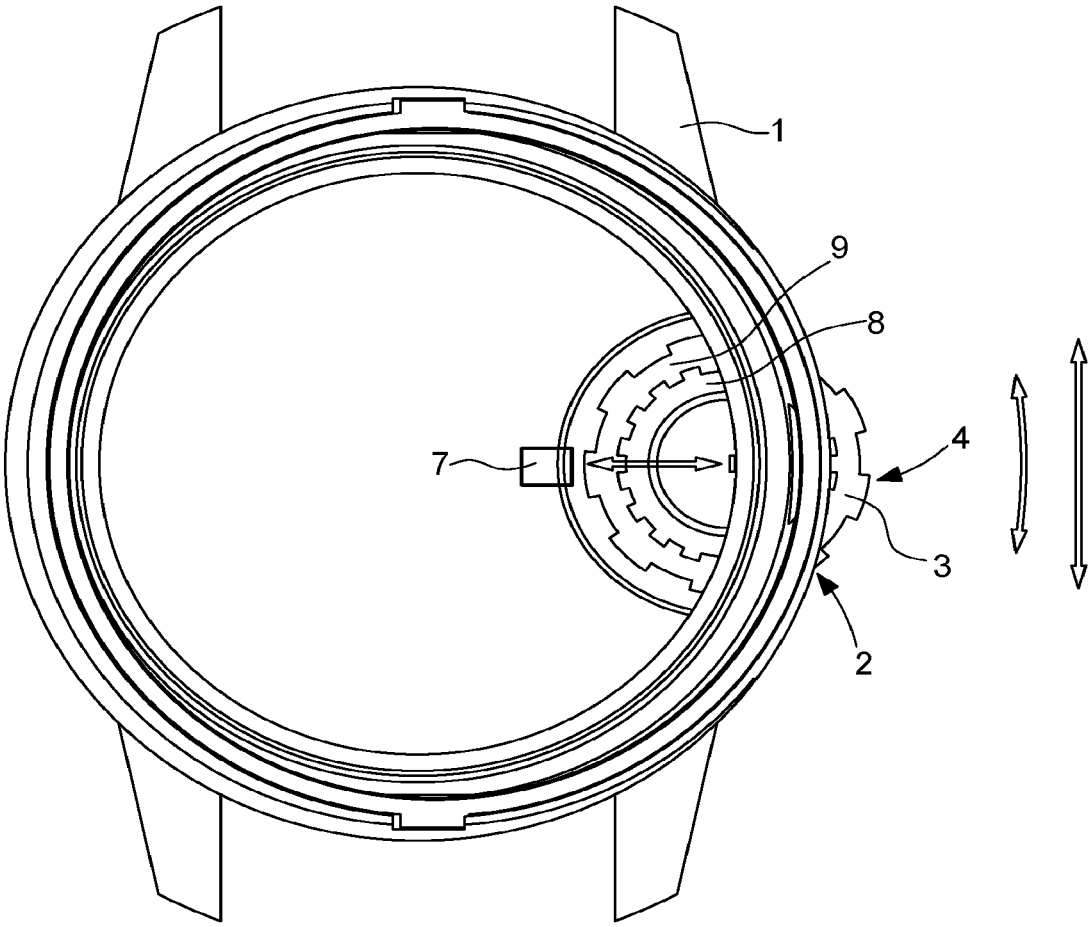
FIG. 22 represents a case including a mini-thumbwheel that barely encroaches on the surface area of the movement.

FIG. 20 illustrates a variant wherein the pusher includes, instead of a pad, a pinion 57 cooperating with a toothing 37 comprised then in thumbwheel 3, or which is placed on the thumbwheel, the pusher stem then allows translation and rotation detection.

The invention also concerns a watch 200 comprising such a case 1, arranged to contain a timepiece movement 100, wherein the display or watch functions are arranged to be controlled by sensor means 8 of case 1.

The mechanism according to the invention offers various advantages.

Firstly, this system poses no risk to the sealing of the watch, since the areas to be sealed concern systems that are already known and mastered, such as the crystal/case and pusher/case connections. The sensor that detects pressure is mounted in the movement and is activated by the pusher which can easily be made water-resistant. The sensors for detecting rotation are on the movement. Since magnetic detection is contactless, there is no problem of sealing.

In principle, the thumbwheel pushing function can be performed by a pusher that does not lead to the interior of the case or of the case middle. In particular, in the illustrated variants, a suitable design of the notching system, of the force and position of the magnets, and of the position of the magnetic sensors, makes detection possible of the translation and rotation of the thumbwheel. Other contactless solutions, particularly galvanic or optical solutions, are achievable, but less economical to produce. The use of a deformable wall, especially for a plastic watch case, makes contactless detection of translation possible.

Another advantage of the invention, in the preferred but non-limiting variant of magnetic detection, is the possibility of using the watch underwater or in a damp environment.

There is a broad area available for the user's finger to activate the thumbwheel, which provides good detection resolution: in the case of an electronic watch or of a connected or smart watch, the user does not have to turn the thumbwheel numerous times to scroll through the menus (compared to an electronic crown for example). This advantage arises from the fact that the thumbwheel goes all the way around the movement.

The notching system enables the user to feel how many steps he is moving forward.

The invention can be used for crowns, bezels, and with thumbwheels of different sizes: bezels surrounding all or part of the movement, or mini-thumbwheels encroaching as little as possible on the geometric area of the movement.

The invention claimed is:

1. A watch case comprising:

at least one rotationally moveable thumbwheel for controlling a display or a function of the watch;

a housing inside which is the at least one thumbwheel, the thumbwheel is configured to be manipulated directly by a user of the watch via a peripheral contact surface, the housing is configured to allow a limited translational motion, between an internal end position and an external end position, of at least one portion of the thumbwheel in a radial direction of the case, against an elastic return configured to move the portion away from an interior of the case;

at least a first control detector configured to detect presence of the portion of the thumbwheel close to a center of the case when pressure is imparted by the user, or in an internal end position;

at least one transmitter included in the thumbwheel, the at least one transmitter is discontinuous and is arranged at different angular intervals around the thumbwheel; and at least one sensor included in the case in proximity to the housing, the at least one sensor is configured to detect passage of the at least one transmitter when a rotational movement is imparted to the thumbwheel by the user, and wherein the first control detector is configured to activate or deactivate the at least one sensor based on the detection of the presence of the portion of the thumbwheel close to the center of the case.

2. The case according to claim 1, wherein the at least one sensor is configured to detect at least one of direction of travel and reversal of direction of travel of the transmitter.

3. The case according to claim 1, wherein the at least one sensor is configured to detect the angular distance between two the transmitters.

4. The case according to claim 1, wherein at least two of the sensors are configured to detect passage of the transmitter.

5. The case according to claim 1, wherein at least one of the sensor is configured to measure an angle of rotation of the thumbwheel after control detection has been effected by the first detector.

6. The case according to claim 1, further comprising:

a controller configured to control signals transmitted and received in the first detector and the sensor, to activate or deactivate the sensor and, when the sensor is activated, to analyze a number of the transmitters identified by the sensor and/or angular distance between pairs of the transmitters, and/or directions of travel of the transmitters, to transform a result of analysis into an order for display or activation of a watch function, addressed to a timepiece movement contained in the case.

7. The case according to claim 1, wherein the thumbwheel is flexible and itself forms the elastic return.

8. The case according to claim 1, wherein the thumbwheel is rigid, and the elastic return includes a pusher configured to rest on the thumbwheel.

9. The case according to claim 1, wherein the thumbwheel is annular, and the housing is a substantially annular groove, of variable width, and wherein projection of the annular groove onto a line parallel to the radial direction of the case is at least equal to the distance between the internal end position and the external end position.

10. The case according to claim 1, wherein the first detector is a switch activated by the elastic return or by a pusher included in the elastic return.

11. The case according to claim 1, wherein the at least one sensor includes magnetic sensors, which, once activated, are arranged to detect passage of magnets included in the at least one transmitter.

12. The case according to claim 11, wherein the at least one transmitter is arranged at different angular intervals around the thumbwheel.

13. The case according to claim 1, wherein the thumbwheel includes, on a face configured to cooperate with the bottom of the housing, a relief portion configured to cooperate with a complementary relief portion included in the bottom, for braking by notches during rotation of the thumbwheel.

14. The case according to claim 1, wherein the thumbwheel includes, on a face arranged to cooperate with the bottom of the housing, a relief portion configured to cooperate with a notched ring inserted between the thumbwheel and the bottom, for braking by notches during rotation of the thumbwheel.

15. The case according to claim 1, further comprising a cover or a bezel or a back cover for enclosing the thumbwheel in the case.

16. The watch comprising a case according to claim 1, configured to contain a timepiece movement, wherein display or watch functions are controlled by the sensor of the case.

* * * * *